US006698169B1

(12) United States Patent
Bostock

(10) Patent No.: US 6,698,169 B1
(45) Date of Patent: Mar. 2, 2004

(54) SAFETY STIRRUP

(75) Inventor: Hayden Bostock, Camberwell (AU)

(73) Assignee: Bostock Developments Pty Ltd., Melbourne (AU)

( * ) Notice: Subject to any disclaimer, the term of this patent is extended or adjusted under 35 U.S.C. 154(b) by 0 days.

(21) Appl. No.: 10/048,078

(22) PCT Filed: Jul. 20, 2000

(86) PCT No.: PCT/AU00/00867

§ 371 (c)(1),
(2), (4) Date: May 29, 2002

(87) PCT Pub. No.: WO01/07358

PCT Pub. Date: Feb. 1, 2001

(30) Foreign Application Priority Data

Jul. 23, 1999 (AU) ..... PQ 1803

(51) Int. Cl.[7] ..... B68C 3/00
(52) U.S. Cl. ..... 54/49
(58) Field of Search ..... 54/49

(56) References Cited

U.S. PATENT DOCUMENTS

| | | | | | |
|---|---|---|---|---|---|
| 341,987 | A | * | 5/1886 | Allen | 54/49 |
| 408,944 | A | * | 8/1889 | Welcome | 54/49 |
| 445,411 | A | * | 1/1891 | Pearson et al. | 54/49 |
| 535,870 | A | * | 3/1895 | Taylor | 54/49 |
| 908,265 | A | * | 12/1908 | Ivey | 54/49 |
| 1,276,540 | A | * | 8/1918 | Kall | 54/49 |
| 1,321,653 | A | * | 11/1919 | Luttinger | 54/49 |
| 4,995,226 | A | * | 2/1991 | Kuhn, Jr. | 54/49 |

FOREIGN PATENT DOCUMENTS

| | | |
|---|---|---|
| AU | B-39229/85 | 9/1985 |
| AU | A-62109/90 | 3/1991 |
| AU | B-39191/95 | 10/1996 |
| AU | A-65521/99 | 7/2000 |
| EP | 0 065 714 B1 | 11/1989 |
| WO | WO 97/49635 | 12/1997 |

* cited by examiner

*Primary Examiner*—Son T. Nguyen
(74) *Attorney, Agent, or Firm*—Sheridan Ross P.C.

(57) ABSTRACT

A safety stirrup suitable for horse riding, including a generally U-shaped mounting member and a foot support member for receiving a rider's foot, such that when the rider's foot is in the normal use position the foot support is restrained by at least one mounting, and wherein upward vertical movement of the rider's foot out of the normal use position causes the mounting to release the foot support sufficiently that the foot support can move in the same direction as the rider's foot until the foot support is fully disconnected from the U-shaped mounting member.

6 Claims, 3 Drawing Sheets

SAFETY STIRRUP

Figure 1:
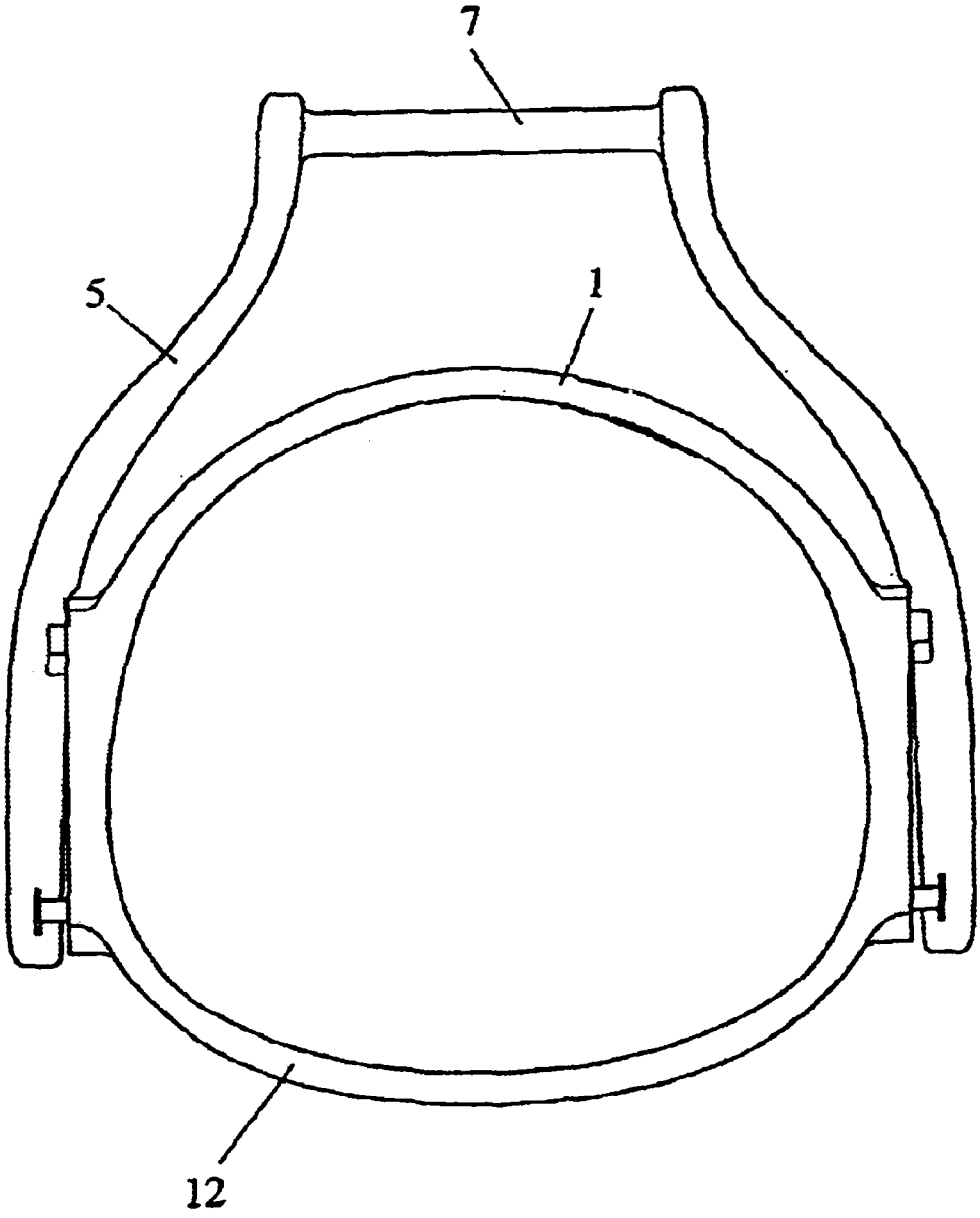

The present invention relates to a horse riding stirrup. In particular, the present invention relates to a safety stirrup which prevents the rider's foot being retained in the stirrup in the event of the rider being dismounted or thrown from the horse. More particularly, the present invention relates to a novel two-way release safety stirrup.

Stirrups are well known in the prior art and have been used for hundreds of years. In general, a stirrup includes a D-shaped metal structure with a slot located in the centre of the arcuate portion of the D-shaped structure for attachment of a stirrup strap, which in turn connects to a saddle. In use, the rider's foot is inserted into the D-shaped structure and the straight, base portion known as a footplate is located adjacent the sole of the rider's boot while the arcuate portion of the stirrup is located adjacent the upper of the rider's boot.

One of the problems associated with stirrups of the prior art is that if the rider is dismounted or thrown, they may not have sufficient time to withdraw their foot from the stirrup. Often the D-shaped structure fits firmly around the rider's boot, thus trapping the rider's foot. If the foot remains trapped in the stirrup, and the horse continues moving, the rider can be dragged along, often causing serious injury or death. Each year many people are injured or killed in this type of accident.

In order to overcome this well known problem, attempts have been made to provide safety stirrups that release the rider's foot if the rider is dismounted or thrown from the horse. One form of safety stirrup of the prior art includes a frangible or weakened portion adjacent the point where the stirrup is attached to the stirrup strap. If the rider is dismounted or thrown and their foot remains caught in the stirrup, the frangible portion breaks, releasing the stirrup from the stirrup strap. However this type of safety stirrup suffers from the drawback that it may break away from the stirrup strap during particularly hard riding, leaving the rider unbalanced, and unable to control the horse using his or her feet. Furthermore, the rider cannot re-mount until a new stirrup is fitted, which can be difficult or inconvenient if the stirrup breaks away in an isolated area. Furthermore, the frangible stirrup does not prevent leg injuries and is therefore of limited value for novice or disabled riders. A further disadvantage is that these stirrup are very bulky in the region where they attach to the stirrup strap and the increased bulk often causes excessive wear to the rider's clothing.

Another type of safety stirrup is disclosed in EP-0 065 714. This safety stirrup comprises a U-shaped release member supported at either end of the U-within a D-shaped mounting member. During normal riding, the D-shaped mounting member and the U-shaped release member lie in the same plane. During normal riding, the sole of the rider's boot rests against the flat portion or footplate of the D-shaped member. If the rider is dismounted, the rider's foot causes the U-shaped release member to pivot out of the plane of the stirrup, concomitantly causing the footplate of the D-shaped mounting member to release at one end while the other end pivots away from the rest of the D-shaped mounting member. This allows the rider's foot to be released from the stirrup.

Other safety stirrups are described in AU-39229/95 and DE-2003387. These safety stirrups also comprise articulated members that separate and release the rider's foot if the rider is dismounted or thrown.

Another, quite different type of safety stirrup is described in U.S. Pat. No. 1,276,819. The stirrup comprises a pair of hingedly engaged, downwardly extending arms forming a U-shaped member, with the footplate hingedly engaged adjacent the end of one of the arms and releasable engaged adjacent the end of the other arm. The stirrup further comprises a vertically slideable plate which in use rests against the upper of the rider's boot. If the rider's foot moves upwards, out of the normal in-use position, the plate slides upwards, activating a mechanism which causes one end of the footplate to release from one arm of the U-shaped member, thus releasing the rider's boot.

Most safety stirrups can be classed as "one-way" release or "two-way" release stirrups. The "one-way" stirrup requires that the rider's foot be inserted in the stirrup in one particular direction or from one particular side if the release mechanism is to operate properly. Pressure exerted in the forward direction, that is, towards the rider's toe, will not cause the safety stirrup to release. Only pressure exerted in the rearward direction, that is, towards the rider's heel will cause the safety stirrup to release. Because the stirrup only opens up in one way or one direction, it is important that the rider's foot is inserted from the correct side of the stirrup, otherwise the release mechanism will not operate properly.

Conversely a "two-way" safety stirrup will release if pressure is exerted from either the forward or rearwards direction, hence the rider can place their foot in a two-way stirrup from either direction.

For example a typical one-way safety stirrup is disclosed in AU-62109/90. The safety stirrup of AU-62109/90 holds the rider's foot in a restraint that separates when the restraint is pivoted out of the normal position. International application PCT/AU97/00398 discloses another one-way safety stirrup. The safety stirrup of PCT/AU97/00398 also comprises a restraining means pivotally mounted between two extremities of an inverted U-shaped mounting means.

As mentioned above, when attached correctly to stirrup straps, the one-way stirrups of the prior art release and open up only if the rider's foot pivots rearwards. Because they only open in the rearwards direction, they cannot open up if the rider's foot pivots forwards or pushes hard into the stirrup, as may occur as a result of very hard riding such as during a polo match or rodeo riding. While the one-way stirrup works well for all standards of riding including very hard riding, one-way stirrups of the prior art suffer from the disadvantage that they do not open up in response to certain types of riding accidents. For example, a one-way stirrup will not release if the rider's foot exerts strong forward pressure as the rider is thrown over the head of the horse, or to the side of the horse or in the course of jumping. Another problem with some designs of one-way stirrup of the prior art is that the rider's foot may still be retained within the U-shaped mounting means even when the restraint is pivoted out of the normal position and separates.

Furthermore, as already mentioned, the correct operation of one-way stirrups is conditional on the stirrup being connected to the stirrup strap in one specific orientation, such that the rider's boot is inserted only in one particular direction into the stirrup. If the stirrup is oriented in the wrong direction it can release unexpectedly and lead to rider injury and/or loss of control of the horse. There is a risk that some riders, in particular novice riders, may unwittingly connect a one-way stirrup to the stirrup strap in the wrong orientation.

For these reasons, many riders prefer two-way stirrups. An example of a two-way safety stirrup of the prior art is disclosed in AU-26089/95. AU-26089/95 discloses a stirrup in which the rider's boot is held in a D-shaped restraint means which is pivotally mounted between two extremities of an inverted U-shaped mounting means. If the rider is dismounted from the horse, the restraint means pivots out of the normal position, one of the pivotal mountings releases from the mounting member, and the restraint means separates, thus releasing the foot from both the restraint and the inverted U-shaped mounting means.

One of the disadvantages of two-way stirrups of the prior art is that the restraint means can be pushed out of the normal position by the movement and pressure exerted by hard riding. The amount of forward pressure required to cause the safety stirrup to release is approximately the same as the amount of rearward pressure required to cause release. Professional riders such as jockeys, mountain cattlemen, rodeo riders, polo players and the like exert enormous pressure on stirrups as they pull up a horse or lean back to resist being thrown over the horse's head. The pressure of the rider's foot being pressed hard into the stirrup can cause a two-way stirrup to suddenly release, unbalancing the rider and potentially causing them to fall from the horse.

Typically, the safety stirrups of the prior art also have the disadvantages of being made of metal, and thus being relatively heavy, and of having relatively complicated construction. In general, the stirrups of the prior art comprise articulated members or complicated joints between members which separate when the rider is dismounted—the articulation and complicated construction contributing to the cost of construction.

It is an object of the present invention to provide a two-way safety stirrup that provides the desirable advantages of release in the event of the rider being dismounted, but which is less prone to unexpected release when pressure is applied in the forward direction. It is a further object to provide a safety stirrup that is of far simpler construction than stirrups of the prior art, yet is not as prone to unexpected release and which can be made of materials other than metal (such as plastics and polymers) so that the stirrups are more economical to manufacture and are of comparatively light weight.

Accordingly, the present invention provides a safety stirrup including:

a generally U-shaped mounting member, and a foot support member for receiving a rider's foot, such that when the rider's foot is in the normal use position, the foot support is restrained by at least one mounting on the mounting member, and wherein vertical movement of the rider's foot out of the normal use position causes the mounting to release the foot support sufficiently that the foot support can move in the same direction as the rider's foot until the foot support is fully disconnected from the U-shaped mounting member.

The term "normal use position" is used throughout the specification to denote the position of the rider's foot in the stirrup when a rider is mounting or mounted on a horse to which the stirrup is fitted. When the rider's foot is in the normal use position, the U-shaped mounting member and the foot support are generally co-planar, or have parallel planes. During normal riding the plane(s) is/are approximately vertical and the rider's foot is approximately perpendicular to the plane of the U-shaped mounting member, the toe pointing in the forward position and the heel oriented in the rearward direction.

The present invention makes use of the fact that when the rider's foot moves out of the normal in-use position, such as when the rider is dismounted, there is a vertical component to the movement of the rider's foot. Typically, the rider's foot will move upwards relative to the U-shaped member and then rotate, or just rotate, both movements including a significant vertical force component. In the safety stirrup of the present invention the vertical force component causes vertical movement of the foot support relative to the U-shaped member, such that the foot support is shifted into a position where it can to move in the same forward or rearwards direction as the rider's foot until the foot support is fully disconnected from the U-shaped mounting member.

The generally U-shaped mounting member is typically in the shape of an inverted curve or takes the shape of three sides of a square or rectangle. Typically the foot support is D-shaped, and in normal use the sole of the rider's boot is adjacent the straight part of the D which comprises the footplate.

Typically, there are two mountings are located on either arms of the U-shaped mounting member.

Typically the mounting includes one or more primary projections which can be received in complementary shaped recesses. The primary projections may be located on the U-shaped mounting member and received in recesses in the foot support. Alternatively, the primary projections may be located on the D-shaped foot support, and received in recesses in the U-shaped mounting member. In a particularly preferred embodiment, each primary projection is of generally cylindrical shape, or a boss of convenient cross section.

The recess may be of any convenient shape may be of any convenient shape and depth, sufficient to retain the primary projection and resist rotation of the foot support relative to the U-shaped mounting member when the stirrup is in normal use. Typically, in response to vertical force exerted by the rider's boot, the projection moves in the recess to a position which allows the D-shaped foot support to move in the same direction as the rider's foot.

For example, the recess may be shaped to include an indentation in which the primary projection resides during normal use, and guide or passage along which the primary projection may move in the forwards or rearwards direction in response to the force exerted by the rider's foot when the rider is dismounted.

The at least one mounting may also include two secondary projections located in recesses adjacent the ends of the U-shaped member and footplate of the foot support. Typically the primary and secondary projections are located on the same element (either the U-shaped mounting member or the foot support). In a particularly preferred embodiment, the primary and secondary projections are located on the D-shaped foot support, and received in recesses in the U-shaped mounting member.

In a particularly preferred embodiment, two secondary projections are located on the D-shaped foot support and comprise a long neck and bulbous head, forming a "mushroom" shape. The necks are received in slot-shaped recess at either end of the U-shaped mounting member. Typically, in response to vertical force exerted by the rider's boot, the secondary projection moves in the recess to a position which allows the D-shaped foot support to move in the same direction as the rider's foot.

In this particular embodiment, it is preferred the primary and secondary projections are on the D-shaped foot support and are located in recesses in the U-shaped mounting member. In response to vertical movement of the rider's foot, the primary and secondary projections move vertically upwards in their respective recesses. As the rider's boot rotates, the primary projection follows a curved passage in the recess following the direction of rotation of the rider's boot, until the projection disengages from the U-shaped member. At the same time, the secondary projection rotates in its recess and finally passes out through the slot shaped recess, thus completely disengaging the D-shaped foot support from the U-shaped mounting member.

The safety stirrup of the present invention has the advantage that the release characteristics can be adapted to the rider's skill level and the type of riding being carried out. For example, the primary and secondary projections can be configured such that the rider's foot has to exert greater than normal force in either the forward or rearwards directions in order for the foot support to fully disconnect from the U-shaped mounting member. A professional rider who does hard riding and generally exerts a great deal of force on the stirrup could use a safety stirrup in which the projections fit deeply into the recesses so that a great deal of forward or backwards force would need to be imposed before the foot support could be fully disconnected from the U-shaped mounting member. For example, springs or other biasing means could be used to resist movement of the primary or secondary projections in their recess. Alternatively, for a novice rider who is more likely to fall and less likely to exert a great deal of force on the stirrup, the recesses could be very shallow and shaped so that relatively less forward or backward pressure would be required to fully disconnect the foot support from the U-shaped mounting member.

Furthermore the shape of the primary or secondary projection and corresponding recess could be adapted so that it is easier to disengage the projection from the recess when force is exerted in the forward direction rather than the backward direction. However, as with one-way stirrups, this embodiment would only work properly if the stirrup were mounted on the saddle strap in the correct orientation.

The stirrup strap may be passed through the stirrup between the U-shaped member and the foot support. Alternatively the U-shaped member may be adapted for attachment of a stirrup strap using any conventional arrangement such as a slot in the U-shaped mounting member through which the strap can be threaded, or a bar around which the strap can be wrapped, or a known toggle-type connection.

Typically, the flat, straight section of the D-shaped foot support comprises the footplate against which the sole of the rider's boot rests during mounting or normal riding. The foot support can be in any convenient form, such as a bar, case plate or slotted plate that is oriented in a generally horizontal plane during normal use.

While the safety stirrup of the present invention could be manufactured out of metal, the design is sufficiently simple that it could be manufactured out of other convenient materials such as polymers or plastic, and composites such as carbon/graphite composites. Polymers and plastic provide weight advantages over metal, which is the traditional material of construction for stirrups. Furthermore, polymers, unlike most metals, have the ability to stretch and therefore easily redistribute load forces. Preferably, the safety stirrup of the present invention is formed by injection molding.

The invention will now be further described with reference to the following drawings that depict non-limiting embodiments of the safety stirrup of the present invention.

FIG. 1 is a plan view of one embodiment of the safety stirrup of the present inventions the normal in-use position.

Figure 2A:
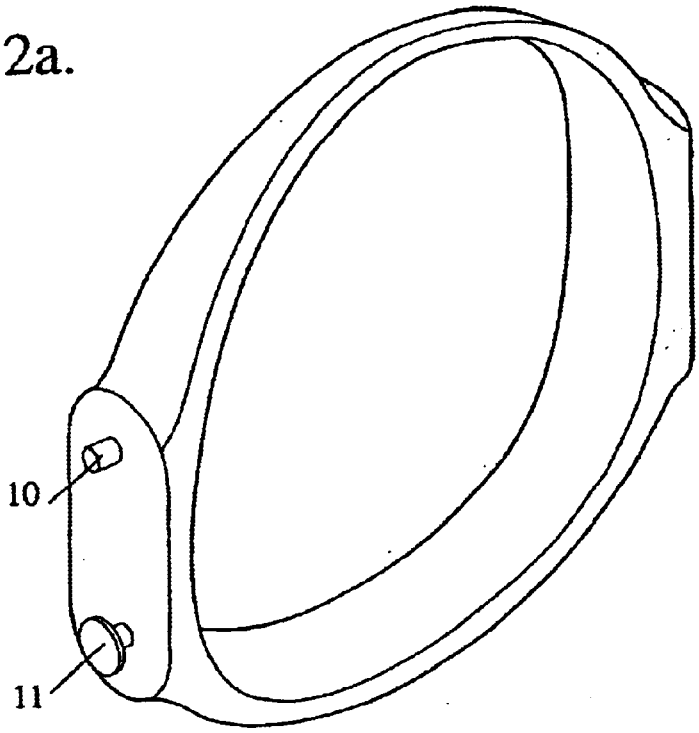

FIG. 2*a* is a perspective view towards the side of a D-shaped foot support of a safety stirrup of FIG. 1.

Figure 2B:
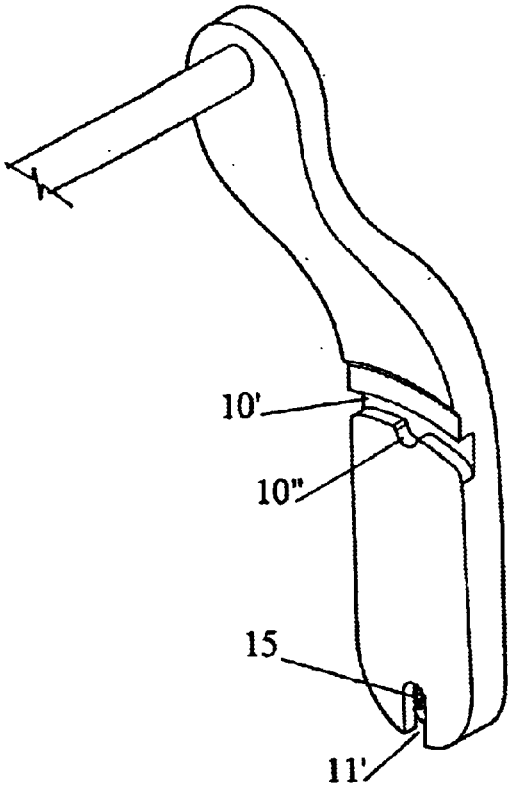

FIG. 2*b* is a view of the inside of one arm of the U-shaped mounting member of FIG. 1.

Figure 2C:
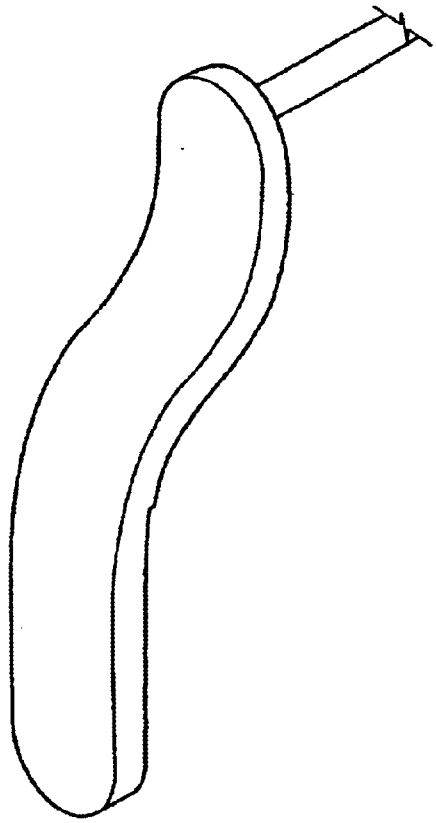

FIG. 2*c* is a view of the outer side of the arm depicted in FIG. 2*b*.

Figure 3A:
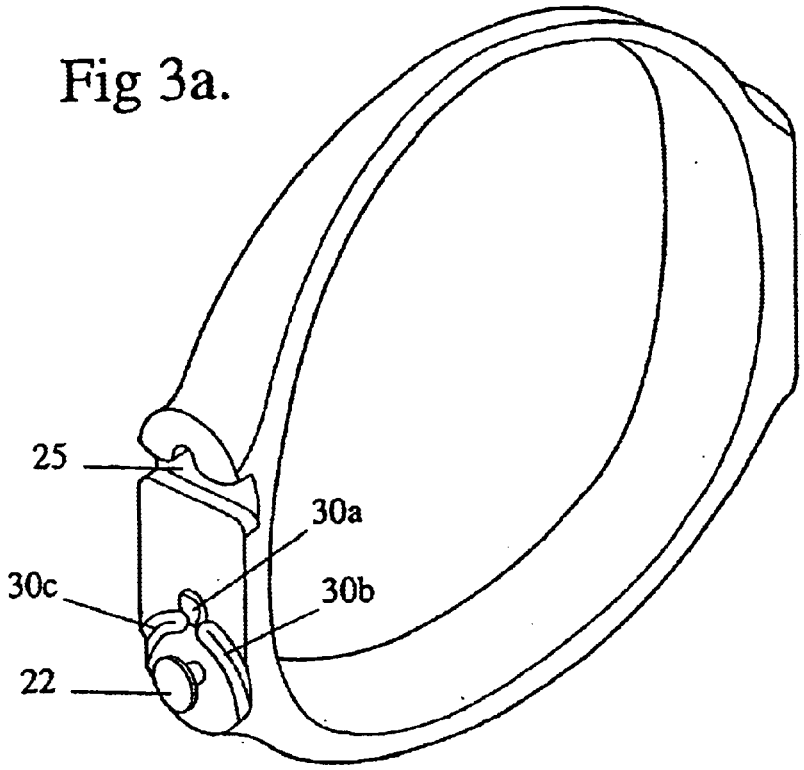

FIG. 3*a* is a perspective view towards the side of a D-shaped foot support of a further embodiment of the safety stirrup of the present invention.

Figure 3B:
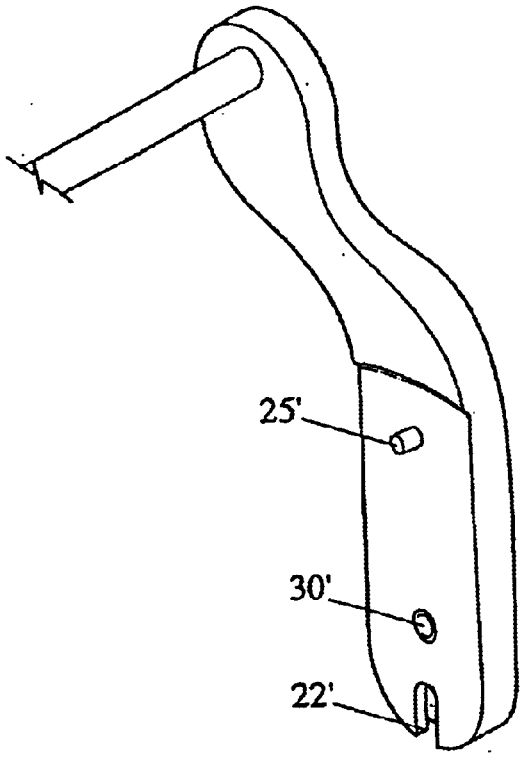

FIG. 3*b* is a view of the inside of one arm of the U-shaped mounting member of the further embodiment.

FIG. 1 is a plan view of a safety stirrup according to the present invention when the stirrup is in the normal in-use position. The drawing shows an inverted U-shaped mounting member (5) comprising a horizontal bar (7) to which the stirrup strap may be attached. Located within the U-shaped mounting member is a D-shaped foot support (1) for receiving a rider's foot, including a footplate (12) which rests against the sole of the rider's boot.

When the stirrup is in normal use, the foot support (10) lies in the same plane as the U-shaped mounting member (5) and is held in place by two mountings located on either side of the U-shaped mounting member.

FIG. 2*a* is a perspective view towards a side of a D-shaped foot support. In this view the cylindrical shaped primary projection (10) and mushroom shaped secondary projection (11) can be seen. Identical projections also exist on the other side of the foot support but cannot be seen in this view.

FIG. 2*b* is a view of one arm of the U-shaped mounting member of FIG. 1 showing recesses (10', 11') for receiving the primary projection (10) and secondary projection (11) of FIG. 2*a*. Recess (11') receives the mushroom shaped projection (11), the neck of the mushroom residing in the slot-shaped part of the recess. The head of the mushroom is located entirely within the U-shaped mounting member and is not visible when the stirrup is in normal use. A biasing means, in this case a spring (15), is located within the recess. Recess (10') receives the cylindrical shaped primary projection (10). In the event of the rider being dismounted, the rider's foot moves out of the normal in-use position. The vertical component of the force exerted by the rider's foot causes the primary projection to move out of the indentation (10") in which it rests, into the passage, or curved part of the recess. The amount of vertical force required will depend on the depth of the indentation. If the indentation is very shallow, the primary projection may almost roll or slide out into the passage. Simultaneously, the secondary projection moves against the force exerted by the biasing means (15). As the rotation of the rider's foot increases, the primary projection follows the passage in the recess (10') in the direction of rotation until it leaves the passage and the projection is no longer in contact with the U-shaped mounting member. As this occurs, the secondary projection (11) rotates in its recess (11') and when the primary projection (10) is free of the U-shaped mounting means, the secondary projection (11) can move out of the recess (11'), thus completely disengaging the foot support from the U-shaped mounting means.

FIG. 2*c* shows the outer side of the arm depicted in FIG. 2*b*. In this view, it is clear that the primary and secondary projections are not visible when the stirrup is in normal use.

FIG. 3*a* is a perspective view towards a side of a D-shaped foot support according to a further embodiment of the safety stirrup of the present invention. In this view, the mushroom shaped second projection (22) can be seen. Above the second projection is a discontinuous recess comprising an indentation (30*a*) and two passages (30*b*, 30*c*) for receiving a third projection on the D-shaped foot support. A recess (25) comprising an indentation and elongate passage for receiving a primary projection on the D-shaped foot support is also shown. Identical projections and recesses also exist on the other side of the foot support but cannot be seen in this view.

FIG. 3*b* is a view of one arm of the U-shaped mounting member of the further embodiment showing the primary projection (25') to be received in the recess (25) depicted in FIG. 3*a*. Recess (22') is for receiving the mushroom shaped secondary projection (22) depicted in FIG. 3*a*, the neck of the mushroom residing in the slot-shaped part of the recess, the head of the mushroom being visible on the outside of the U-shaped member when the stirrup is in normal use. During normal use of the stirrup, a third projection (30') is located within the indentation (30*a*) depicted in FIG. 3*a*. In the event of the rider being dismounted, the rider's foot moves out of the normal in-use position. The vertical component of the force exerted causes the D-shaped foot support to move vertically upwards relative to the U-shaped support member, so that primary projection (25') moves out of the indentation in the recess (25) and into the elongate passage. Simultaneously, the secondary projection (22) moves upwards in the recess (22'), the third projection (30') moving out of the indentation (30*a*) and into either passage 30*b* or 30*c*, depending on the direction of rotation of the D-shaped foot support. This movement of the third projection (30') is facilitated in part by flexing of the U-shaped member, which thus acts as a biasing means. As the rotation of the rider's foot increases, the primary projection (25') follows the moves along the recess (25) in the direction of rotation until it leaves the passage and the projection is no longer in contact with the U-shaped mounting member. As this occurs, the secondary projection (22) rotates in its recess (22') and when the primary projection (25') is free of the U-shaped mounting means, the secondary projection (22) can move out of the recess (22'), thus completely disengaging the foot support from the U-shaped mounting means.

Figure 3C:
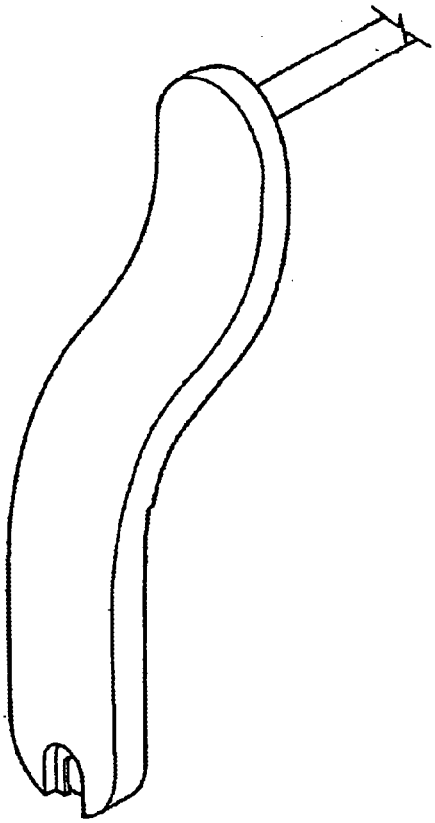

FIG. 3*c* shows the outer side of the arm depicted in FIG. 3*b*. In this view, it is clear that the head of the mushroom shaped secondary projection would be visible when the stirrup is in normal use.

While the foregoing describes preferred embodiments of the invention, various modification scan be included without departing from the spirit and scope of the invention.

What is claimed is:

1. A safety stirrup including:

a generally U-shaped mounting member, and a foot support member for receiving a rider's foot, such that when the rider's foot is in the normal use position, the foot support member is restrained by mountings located on each side of the foot support member having primary projections and secondary projections on the foot support member, wherein during normal use the secondary projections are located in recesses adjacent the ends of the U-shaped mounting member but vertically upward movement of the rider's foot out of the normal use position causes the mountings to release the foot support member sufficiently that the foot support member can move in the same direction as the rider's foot until the foot support member is fully disconnected from the U-shaped mounting member, the secondary projections moving in their respective recesses and rotating in the same direction as the rider's foot prior to the foot support member being fully disconnected from the U-shaped mounting member.

2. A safety stirrup according to claim 1 having two mountings, each mounting comprising at least one primary projection which, when the stirrup is in the normal use position, is received in complementary shaped recess.

3. A safety stirrup according to claim 2 wherein at least one primary projection is located on one side of the foot support member, and at least one primary projection is located on an opposing side of the foot support member, each primary projection being received in a complementary shaped recess in the U-shaped mounting member.

4. A safety stirrup according to claim 3, wherein at least one of the complementary shaped recesses includes an indentation in which the primary projection resides during normal use, but vertical movement of the rider's foot out of the normal use position causes the primary projection to move out of the indentation, releasing the foot support sufficiently that the projection can move along a guide and the foot support member can move in the same direction as the rider's foot prior to the foot support being fully disconnected from the U-shaped mounting member.

5. A safety stirrup according to claim 1 which further includes a biasing means to resist movement of the secondary projections in their respective recesses.

6. A safety stirrup according to claim 1 which is constructed of non-metallic material.

* * * * *